United States Patent [19]

Morman

[11] 4,188,965

[45] Feb. 19, 1980

[54] BODY MOUNTED UMBRELLA

[76] Inventor: John W. Morman, 1622 E. 75th Ter., Kansas City, Mo. 64131

[21] Appl. No.: 916,965

[22] Filed: Jun. 19, 1978

[51] Int. Cl.[2] ..... A45B 11/02

[52] U.S. Cl. ..... 135/5 C; 135/20 R

[58] Field of Search ..... 135/5 C, 16, 17, 18, 135/19, 20 R; 224/5.1

[56] References Cited

U.S. PATENT DOCUMENTS

| | | | |
|---|---|---|---|
| 171,967 | 1/1876 | Arnold | 135/5 C |
| 578,572 | 3/1897 | Lashells | 135/5 C |
| 903,682 | 11/1908 | Cumpston | 135/5 C |
| 3,792,680 | 2/1974 | Allen | 52/113 |

*Primary Examiner*—Reinaldo P. Machado

*Attorney, Agent, or Firm*—Lowe, Kokjer, Kircher, Wharton & Bowman

[57] ABSTRACT

A collapsible umbrella shade is mounted to the body of the user by means of a belt to which a vertical post is pivoted. A shaft carrying the shade is pivoted to the top end of the post and may be folded downwardly to a compact storage position. During use, a removable pin maintains the shaft in an extended position wherein it forms an upward continuation of the post to locate the umbrella shade directly overhead. A pair of springs stabilize the post in its normal upright position, while wire arms serve as handles for displacing the post in order to provide already access to the pin and the operating mechanism for opening and closing the umbrella shade.

4 Claims, 3 Drawing Figures

BODY MOUNTED UMBRELLA

BACKGROUND AND SUMMARY OF THE INVENTION

This invention relates generally to umbrellas and more particularly to an improved umbrella of the type that is attached to the body.

It is often inconvenient to hold an umbrella in the hand in the normal manner, as when the user is engaged in fishing or undertaking another activity which requires the use of both hands. Consequently, devices of various types have been proposed for attaching umbrellas to the body in order to free the hands. However, such devices have not been satisfactory in all respects.

One major problem has been the inaccessability of the operating mechanism for the umbrella. Since the umbrella is mounted on the back, it is difficult to reach in order to open and close the shade or to remove the umbrella from the harness or other device that attaches it to the body. Moreover, it is usually necessary to completely remove the harness device from the body in order to close the umbrella shade. Therefore, the umbrella must be carried by hand when closed and must be opened and reattached to the body when it is to be used again. Manifestly, this procedure is cumbersome and time consuming and detracts from the ease of use of the device.

It is typical for prior art umbrella carriers of this type to present a long vertical post which is awkward to carry on the back, particularly when the umbrella is not in use. Additional problems have been encountered in maintaining the umbrella shaft in a vertical position so that the shade is located directly overhead during use. Further, the devices which have been proposed in the past are overly complex and expensive and are so heavy and bulky that they are difficult to carry and store.

It is the principal object of the present invention to provide the body mounted umbrella which is improved over prior art devices both in its construction and in its operating characteristics.

More specifically, it is an object of the invention to provide a body mounted umbrella having a shaft that may be folded in half when not in use, thereby permitting the umbrella to be carried in a compact storage position.

Another object of the invention is to provide an umbrella of the character described having operating mechanisms which are readily accessible. It is an important feature of the invention in this respect that the umbrella shade may be easily opened and closed and the shaft may be folded and unfolded without requiring the umbrella to be removed from the back. Accordingly, the umbrella may remain on the back when not in use and also when being opened and closed.

A further object of the invention is to provide an umbrella of the character described which is firmly attached to the body and which includes reliable means for stabilizing the umbrella shaft in a vertical position to maintain the shade directly overhead.

An additional object of the invention is to provide an umbrella of the character described which is light in weight and which is simple and economical to construct.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
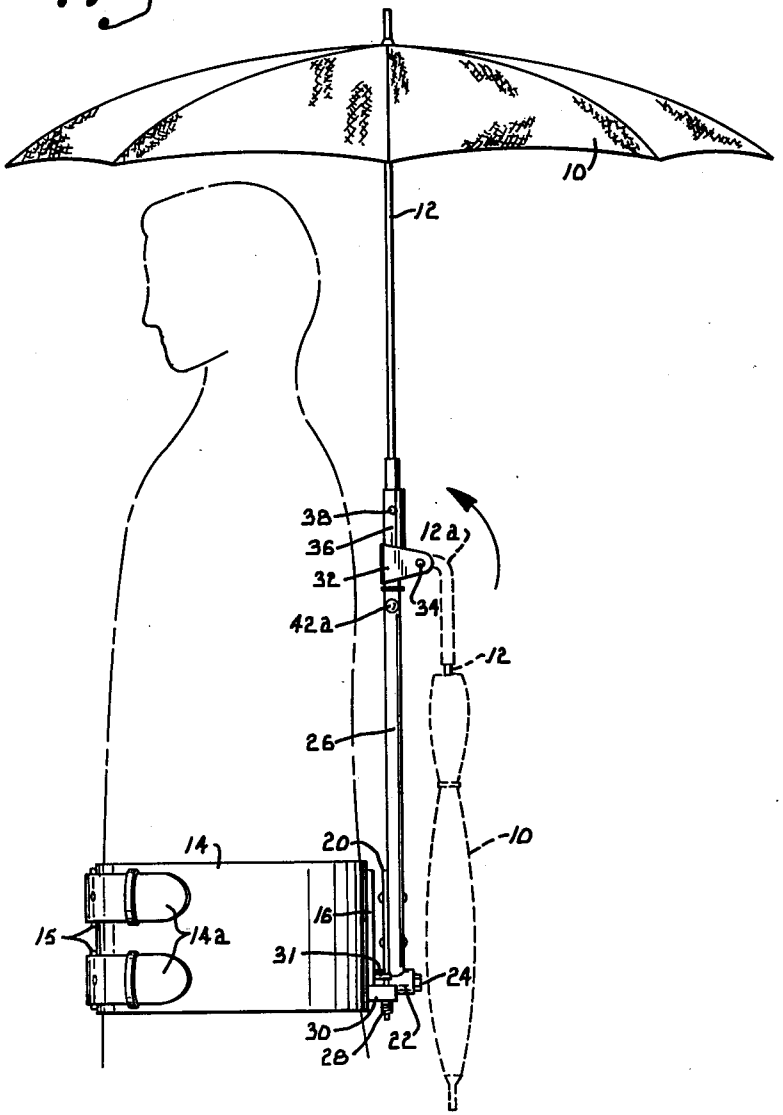
FIG. 1 is a side elevational view of an umbrella mounted on the body of a user in accordance with the present invention, with the broken lines indicating the storage position of the umbrella.

Referring now to the drawings in detail, numeral 10 designates a conventional collapsible umbrella shade which is mounted on a shaft 12 in the usual manner. The shade 10 may be collapsed on shaft 12 from the open position shown in solid lines in FIG. 1 to the closed position shown in broken lines. The lower end of shaft 12 is enlarged and is curved to the rear in a manner to present a short horizontal stub 12*a*.

Figure 2:
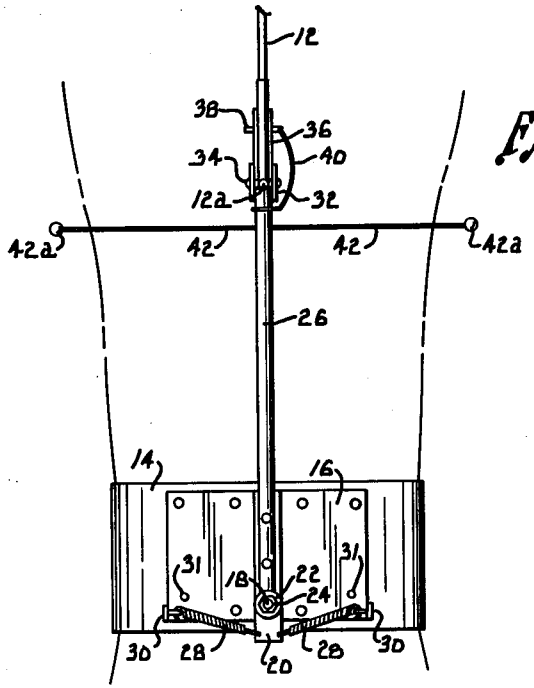
FIG. 2 is a fragmentary rear elevational view of the umbrella shown in FIG. 1, with the post in the normal upright position.

The umbrella is attached to the body of the user by means of a flexible belt 14 which may be formed of any suitable material. The belt 14 is rather wide and includes end straps 14*a* which are secured by conventional buckles 15 or by any other suitable mechanism that serves to tighten the belt. A rigid metal plate 16 is riveted or otherwise secured flatly against the back portion of belt 14. Extending rearwardly from plate 16 is a horizontal pin 18 (see FIGS. 2 and 3) which is threaded on its rearward end. A flat bar 20 is secured to a cylindrical bushing 22 which is sleeved over pin 18 and is able to turn thereon. A nut 24 is threaded onto the end of pin 18 in order to hold the bushing on the pin while permitting it to freely turn about the horizontal pin axis.

A straight vertical post 26 is riveted or otherwise attached to bar 20 in upward extension therefrom. The post is thus mounted to pivot about pin 18 between the upright position shown in FIG. 2 and the displaced position shown in FIG. 3. Post 26 is biased toward the FIG. 2 position by a pair of springs 28 each having one end hooked to the lower end of bar 20 at a location below pin 18. The opposite ends of the springs are hooked to lugs 30 located on opposite sides of the axis of post 26. The springs 28 act to stabilize post 26 in its upright position since displacement of the post about the axis of pin 18 results in stretching of one of the springs and a resulting force that urges the post to return to the upright position.

Figure 3:
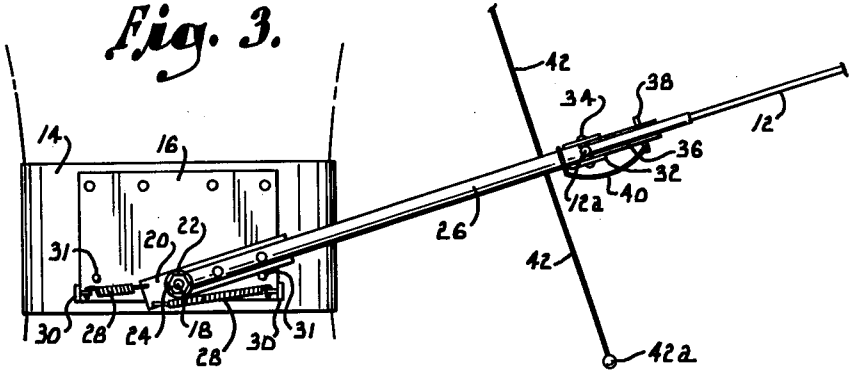
FIG. 3 is a fragmentary view similar to FIG. 2, but showing the post displaced to one side to provide access to the operating mechanisms.

Plate 16 is provided with a pair of stops 31 located on opposite sides of post 26. Stops 31 are engaged by post 26 as shown in FIG. 3 to limit the extent to which the post may be displaced from its normal upright position.

The upper end of post 26 is provided with a bracket 32 having a pair of flat, rearwardly extending arm portions spaced apart from one another. The stub 12*a* of the umbrella shaft 12 is received between the arm portions of bracket 32 and is pivotally connected to the bracket by a horizontal pivot coupling 34. Shaft 12 is thus connected with post 26 for pivotal movement between the solid and broken line positions of FIG. 1. In the solid line position, the shaft forms an upward extension of post 26, while the shaft is folded to extend alongside and parallel to the post in the broken line storage position. It is pointed out that coupling 34 is offset rearwardly of post 26 in order to facilitate pivotal movement of shaft 12 between the extended and folded positions.

The top end of post 26 has an upward extension piece 36 which is located above bracket 32 and which is located above bracket 32 and which is open at the rear in order to receive the enlarged lower end of shaft 12 when same is in the extended position. The shaft is maintained in the extended position by a pin 38 which is extended through an opening formed in the extension piece 36 and through a corresponding opening formed in the enlarged lower end portion of shaft 12. Pin 36 is retained on the end of a flexible wire 40 (FIG. 2) which is tied around post 26 at its opposite end.

A pair of horizontal arms 42 project laterally in opposite directions from post 26 at a location slightly below the bracket 32. Each arm 42 is in the form of a small wire having an enlarged ball 42*a* on its end. As will be explained in more detail, the arms 42 provide handles which facilitate access to pin 38 and the operating mechanism for opening and closing the umbrella shade 10.

In use, belt 14 is extended around the waist and is tightened and secured such that post 26 is centered on the back as shown in the drawing. Springs 28 maintain post 26 in the upright position and resist any forces tended to move the post away from its centered position on the back. When the umbrella shade 10 is needed, it is spread to the open position shown in FIG. 1 and shaft 12 is moved to the extended position. Pin 38 is extended through member 36 and shaft 12 to maintain the shaft in the vertical position such that the shade 10 is located directly over the head of the user.

When the umbrella shade 10 is not needed, one of the wire arms 42 is grasped with one hand to pull post 26 away from its vertical position to the displaced position shown in FIG. 3. In this position, the operating mechanism for opening and closing shade 10 is readily accessible, as is pin 38 since it is located well to one side of the user. After shade 10 has been closed and secured in the closed position, pin 38 is removed and shaft 12 is folded downwardly to the storage position shown in broken lines in FIG. 1. When arms 42 are subsequently released, springs 38 assure that post 26 is returned to the upright position. Arms 42 again provide handles for displacing post 26 when the umbrella is to be raised from the storage position.

It is pointed out that when the unit is in the stored position, the umbrella shaft does not extend above the shoulder area of the user and is thus easily carried at an out of the way position. Further, since arms 42 project beyond the sides of the user, they are easily accessible to facilitate access to pin 38 and the opening and closing mechanism of the umbrella shade.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. In combination with a collapsible umbrella shade mounted on a shaft, the improvement comprising:

a substantially straight post;

means for attaching said post to the body of the user at a substantially centered position on the back;

first means coupling said shaft with said post for pivotal movement about a substantially horizontal axis between an extended position wherein said shaft forms an upward extension of said post to locate said umbrella shade above the head, and a folded position wherein said shaft is folded generally alongside said post;

releasable means for maintaining said shaft in the extended position;

second means mounting said post for pivotal movement about a second horizontal axis from a normally upright orientation to an orientation projecting to one side of the body of said user;

resilient means urging said post toward said upright orientation; and an arm member projecting laterally from said post and providing a handle for displacing said post from its upright orientation to facilitate access to said releasable means.

2. The improvement set forth in claim 1, wherein said attaching means comprises a belt to which said post is mounted, said belt being adapted to extend around the waist of the user.

3. The improvement set forth in claim 2, including a rigid mounting plate secured to said belt, said post being supported on said plate in generally upward extension therefrom.

4. The improvement set forth in claim 1, wherein said horizontal axis of said first means is offset rearwardly from the longitudinal axis of said post to facilitate pivotal movement of said shaft between the extended and folded positions.

* * * * *